United States Patent [19]

Picciuto

[11] Patent Number: 4,679,605

[45] Date of Patent: Jul. 14, 1987

[54] FENCE MACHINING DEVICE

[75] Inventor: Salvatore Picciuto, Piscataway, N.J.

[73] Assignee: Mar-Sal Machine Co., Inc., Greenbrook, N.J.

[21] Appl. No.: 878,618

[22] Filed: Jun. 26, 1986

[51] Int. Cl.[4] ..... B27C 5/00

[52] U.S. Cl. ..... 144/117 R; 144/2 R; 144/134 R

[58] Field of Search ..... 144/2 R, 3 R, 82, 133 R, 144/134 R, 134 C, 203, 117 R

[56] References Cited

U.S. PATENT DOCUMENTS 1,547,096 7/1925 Crouse ..... 144/133 R
3,251,388 5/1966 Ennis ..... 144/3 R
3,779,294 12/1973 Gillis ..... 144/134 R

*Primary Examiner*—W. D. Bray
*Attorney, Agent, or Firm*—Robert D. Farkas

[57] ABSTRACT

A fence machining device for beveling and machining portions of lengths of wood to be used as a portion of a fence. A length of pre-cut lumber is clamped to a work table having an upright frame secured near one end of the lumber. A glidable and pivotable plate is coupled with the upright member such that a rotary cutter, affixed to the tray, can be moved in a vertical direction of selected distance so as to notch the lumber a preselected distance and the same cutter is permitted to describe an arc through a free end of the lumber so as to round off a corner of the lumber. The lumber may be turned over and the procedure repeated to produce thereby a double notched and tapered end of lumber for use in fence constructions.

6 Claims, 5 Drawing Figures

FENCE MACHINING DEVICE

BACKGROUND OF THE INVENTION

1. The Field of the Invention

This invention relates to fence machining devices, and more particularly, that class of device which can be utilized to provide pointed ends of fence materials, coupled with semi-circular indents, to produce a pointed end in a complex design.

2. Description of the Prior Art

The prior art abounds with apparatusses of various constructions used to cut and shape wood for a variety of commercial and decorative uses.

U.S. Pat. No. 316,752, issued Apr. 28, 1885 to P. G. De Blanc, teaches a circular sawing machine in which a shaft is rotably mounted to a plate. The plate is slidably fixed to guide rails. One end of the shaft has affixed thereto a circular saw blade and the other end of such shaft is adapted to have a spur gear, whose teeth are engaged with a rack affixed to one guiderail, the gear being able to concurrently rotate with the shaft. Thus, when the entire assembly is moved laterally along the guides, the spur gear is caused to rotate, since its teeth are engaged within the stationary rack, thereby imparting to the saw blade an additional impetus to rotate as the central axis of the shaft rotably supporting said blade is translated in the direction parallel to the length of the guide rails. It can be seen that in this disclosure, the amount of rotation of the saw blade is proportional to the linear translation of its axis, one function being dependant upon the other.

U.S. Pat. No. 4,112,987, issued Sept. 12, 1978 to Ben E. Pachnik, teaches a supporting device for a conventional router, which device is equipped with at least one side arm, having therein a number of spaced apart holes extending in a line parallel to the longitudinal axis of a cutter blade, mounted in conventional fashion, in a router secured at right angles to the first mentioned plate. By inserting a pin or other pivot bar, through one of the holes, the structure, including the plate to which the router may be affixed, pivots about a pivot bar, describing thereby a path taking by the active and free end of a router bit mounted in the router, which is semi-circular in shape. By permitting the router to travel towards and away from the plate carrying the pivot bar, a wooden work piece may have one or more of its corners, adjacent the free end thereof, routed so as to describe an arcuate shape in three dimensions.

Neither of the aforementioned prior art teachings include a mechanism which permits a circular notch to be disposed within the side of a wooden work piece, and to have the end of the same work piece curved to describe a partial radial surface which may or may not be contiguous with the adjacent edge of the semi-circular notch. Such pleasant and complex design is well known in the fence art.

SUMMARY OF THE INVENTION

The primary object of the present invention is to provide a fence machining device which permits the work piece to be machined easily and conveniently when such machine includes an indented semi-circular notch disposed into and along the length of the work piece.

Another object of the present invention is to provide a fence machining device which permits a fence work piece to have one surface of the end thereof machined to describe a radial cut in the end, commencing on the side of the work piece and terminating at the end thereof.

Still another object of the present invention is to provide a fence machining device which permits a simple fastening of the work piece to the device, followed by minimal mechanical manipulations, so as to permit the work piece to remain stationary whilst it is being machined.

Yet another object of the present invention is to permit a plurality of work pieces to be clamped together, machined together, such that each of the plurality of work pieces are machined identically.

Yet still another object of the present invention is to provide a device for machining fence parts which accurately and repeatedly machines diverse and opposing faces of a workpiece such that the workpiece, when viewed from any angle, is symetrical and uniform in appearance.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a fence machining device employing a table. The table is adapted to confine, in guided and clamped position, one or more pieces of wooden stock, extending along and parallel to the length of the table. Secured to the table and adjacent one end of the table is a rod whose axis is transverse to the length of the wooden stock. Pivotably secured about said rod is a plate. The plate may have its lowermost end pivot upwardly and towards the supporting surface for the wooden workpiece that carries such piece. A carriage, in one range of its motion capabilities, slidably affixed to the plate may move vertically, with no rotation, due to the carriage being slidably engaged with the plate that is rotably secured to the rod. A stop is provided such that the carriage can only move to a certain point upwardly, and, can only descend a maximum amount. In another range of motion of the carriage, as well as the plate, they can pivot about the pivot rod concurrently, so that its lowermost end extends upwardly through the work supporting surface. Rotably secured to the carriage is a longitudinal woodcutter, whose width is greater than the workpiece or pieces stacked and clamped on the workpiece supporting table. A rack is secured to the pivotable plate whilst a spur gear is rotably secured to the carriage and whose teeth engage the teeth of the rack. Depending upon the direction of rotation of the spur gear, the carriage is imparted a vertical force or, upon the spur gear rotating in the opposite direction, the carriage and tray would slidably support same, is caused to permit the cutter to extend upwardly through the work supporting platform. When the cutter is extended vertically upwardly, a semi-circular notch is placed in the workpiece adjacent its free end. When the spur gear is rotated in the opposite direction, the longitudinal cutter is rotated about the pivot rod so as to cause the surface of the cutter to describe a radial surface that is cut into the end of the workpiece approximating the distil end of the piece. When the workpiece is turned over, another semi-circular notch can be formed, opposing and aligned with the first semi-circular notch—and—the opposing end of the workpiece, opposite the now cut semi-circular end, can also be similarly cut, so as to form thereby a double notched, double radius ended fence component of classic design. If desired, the semi-circular notch can be omitted. Alternately, if desired, the tapered and pleasingly rounded end cuts may similarly be omitted. A workpiece whose faces are symetrical, describing an elongated square fence component, can be finished so as to have a castlated appearance as by machining all four sides of the work piece.

Figure 1:
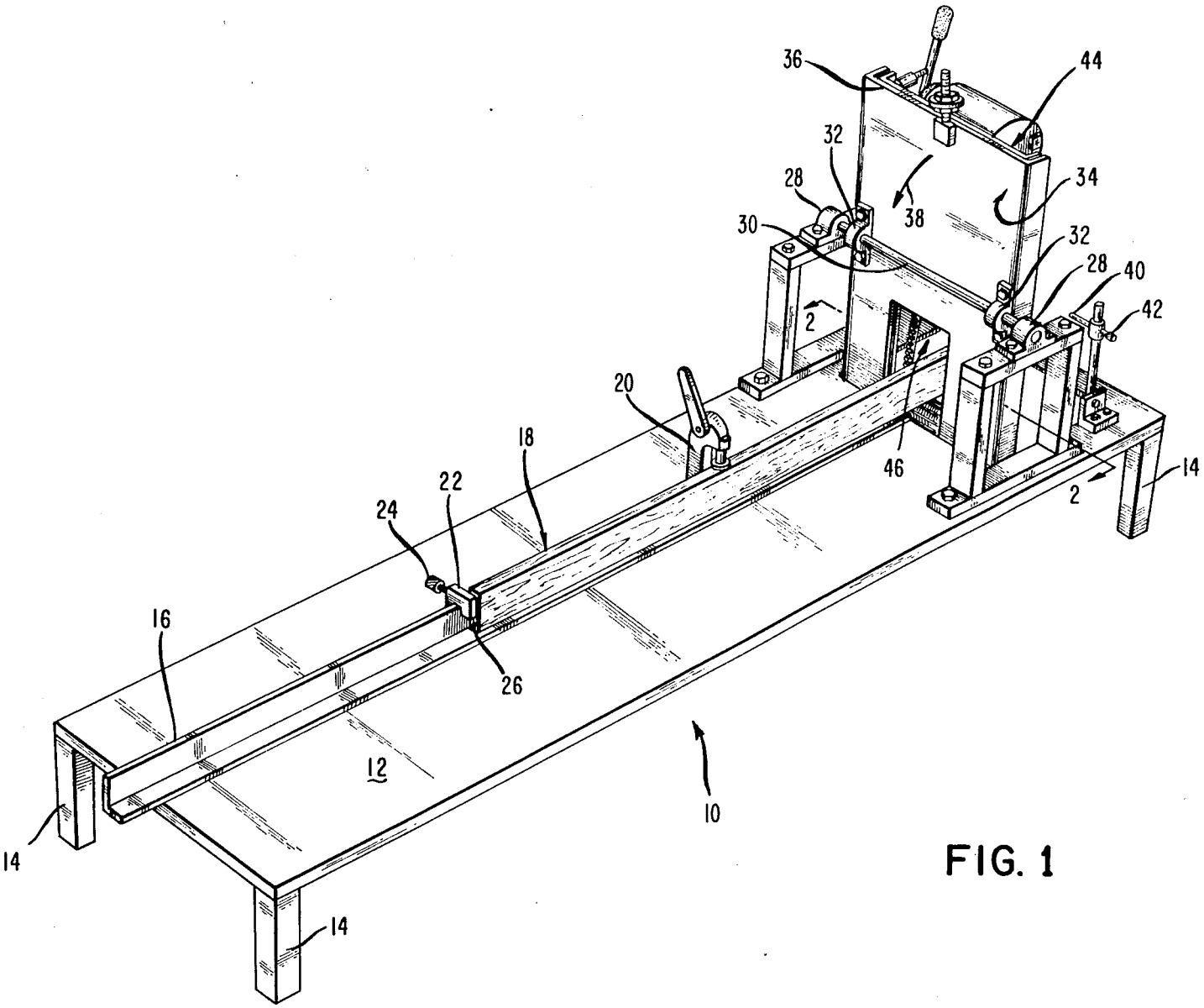
FIG. 1 is a perspective view of the present invention.

Now referring to the figures and more particularly to the embodiment illustrated in FIG. 1 showing the present invention 10 whose work supporting surface 12 is supported by posts 14. Supporting angle 16 is shown supporting workpiece 18 thereon. Clamping device 20, well known in the art, clamps workpiece 18 to angle 16. The position of workpiece 18, along the length of angle 16, is controlled by adjustable stop 22. Screw 24, when loosened and tightened, permits stop 22 to be positioned anywhere desired along the length of angle 16, so as to stop and locate end 26 of workpiece 18. Bearings 28 support pivot rod 30 such that bearings 32 may rotate about the longitudinal axis of rod 30. Plate 34 is supported by bearings 32 and because of such support, uppermost edge 36, of plate 34, can describe an acute path if and when plate 34 is permitted to pivot about the longitudinal axis of pivot rod 30. When plate 34 is displaced in the direction of arrow 38, portions of plate 34, disposed between surface 12 and the longitudinal axis of pivot rod 30, are limited in traveling counter to arrow 38 by stop bar 40. Stop bar 40 may be positioned upwardly and downwardly, inwardly and outwardly, by appropriate loosening and tightening and readjustment of screw 42.

Carriage 44 is shown secured adjacent tray 34 with both carriage 44 and plate 34 having opening 46 therein.

Figure 2:
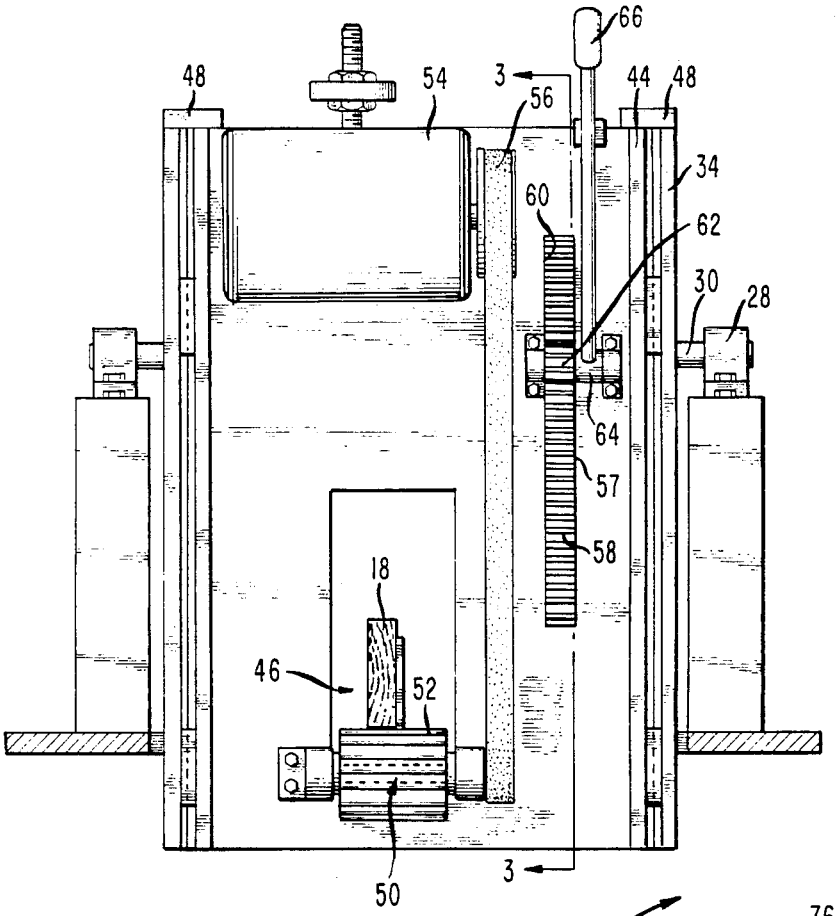
FIG. 2 is a cross-sectional, side elevation view taken along lines 2—2, viewed in the direction of arrows 2—2 of the apparatus shown in FIG. 1.

FIG. 2 illustrates carriage 44, slidably secured to plate 34. Stop members 48 are secured to upper edges of carriage 44 and prohibit carriage 44 from descending below the position shown in FIG. 2, due to the touching engagement with the upper edges of plate 34. In the position shown in FIG. 2, longitudinal cutter 50 is shown having its upper most edge 52 positioned adjacent to the lower most face of workpiece 18. Motor 54, utilizing belt 56 in partial rotation to cutter 50. In the position shown in FIG. 2, cutter 50 will not engage any portion of workpiece 18.

Rack 57 is secured to plate 34. Teeth 58, of rack 57, pass through rectangular opening 60 in carriage 44, which teeth may be engaged by pinion 62. Pinion 62 is non-rotably secured to shaft 64 and will only rotate when shaft 64 is rotated about its longitudinal axis, as by the manual manipulation of hand operating lever 66.

Figure 3:
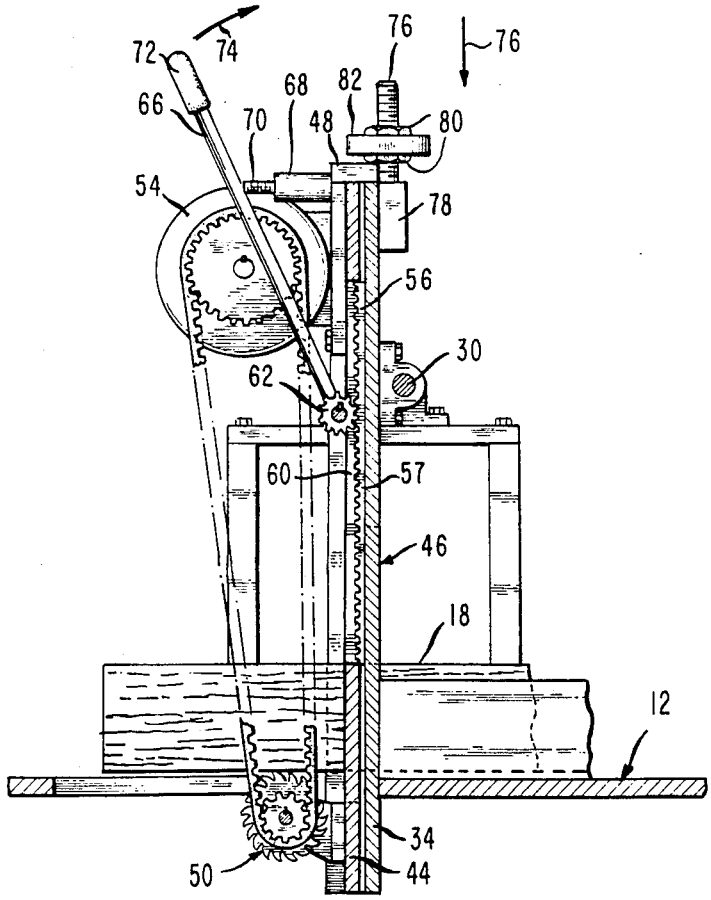
FIG. 3 is a side elevation, cross-sectional view, taken along arrows 3—3, viewed in the direction of 3—3, of the apparatus shown in FIG. 2.

FIG. 3 illustrates block 68 secured to carriage 44. Threaded rod 70 emerges outwardly from block 68 and acts as a stop for operating lever 66, when end 72 thereof is disposed in the direction of arrow 74. If blocks 48 are removed, then, carriage 44 may move downwardly unlimitedly in the direction of arrow 76, only to cause the rotation of pinion gear 62 in the direction of arrow 74, until operating lever 66 strikes the free end of threaded rod 70. By positioning the free end of threaded rod 70, at various locations, circular cutter 50 may have its periphery positioned at various resting positions relative to surface 12. Threaded rod 76 has end 78 thereof secured to plate 34. Nuts 80 engage disc 82 at selected locations along the length of threaded rod 76. By manipulating nuts 80, disc 82 may be positioned to have a preferred height relative to uppermost edge 36 of carriage 44.

Figure 4:
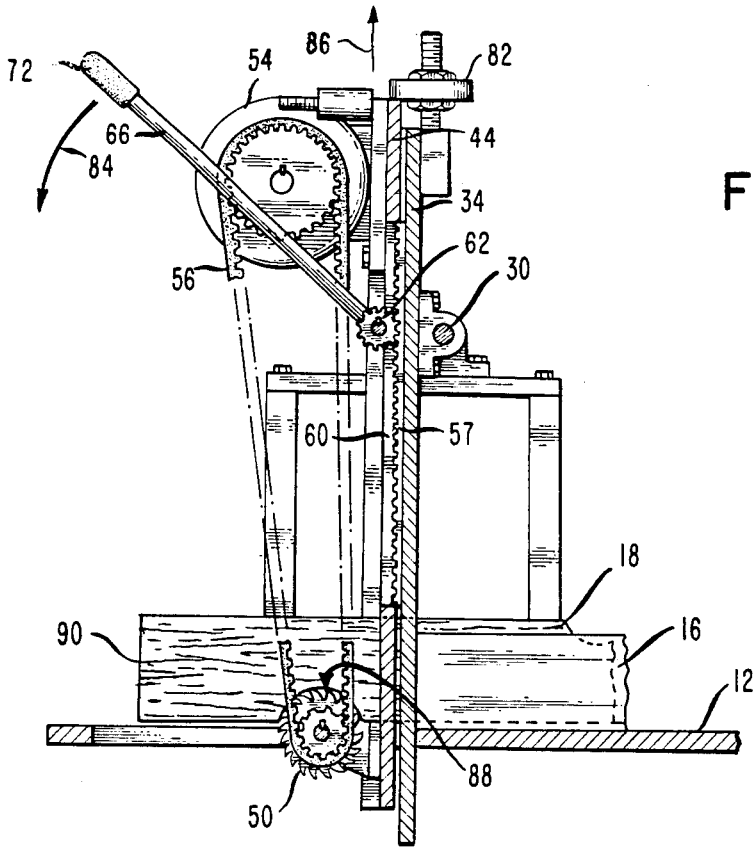
FIG. 4 is a side elevation, cross-sectional view of the apparatus shown in FIG. 3, in which an operating lever is manually operated in a counter-clock wise direction.

FIG. 4 illustrates the free end 72 of operating lever 66, rotated in the direction of arrow 84. In such position, pinion 62 is similarly rotated about its longitudinal axis of rotation, propelling carriage 44 to move upwardly in the direction of 86. The further free end 72 of operating lever 66 is placed in the direction of arrow 84, the further will carriage 44 extend upwardly in the direction of arrow 66, until, such upward translation is terminated by the uppermost edge of carriage 44 engaging disc 82. As carriage 44 moves in the upward direction described by arrow 86, cutter 50 engages workpiece 18, cutting therein a semi-circular notch 88, as shown—adjacent free end 90 of workpiece 18. The repositioning disc 82 in a further upwardly direction, than as shown, would permit notch 88 to be deeper than as shown.

Figure 5:
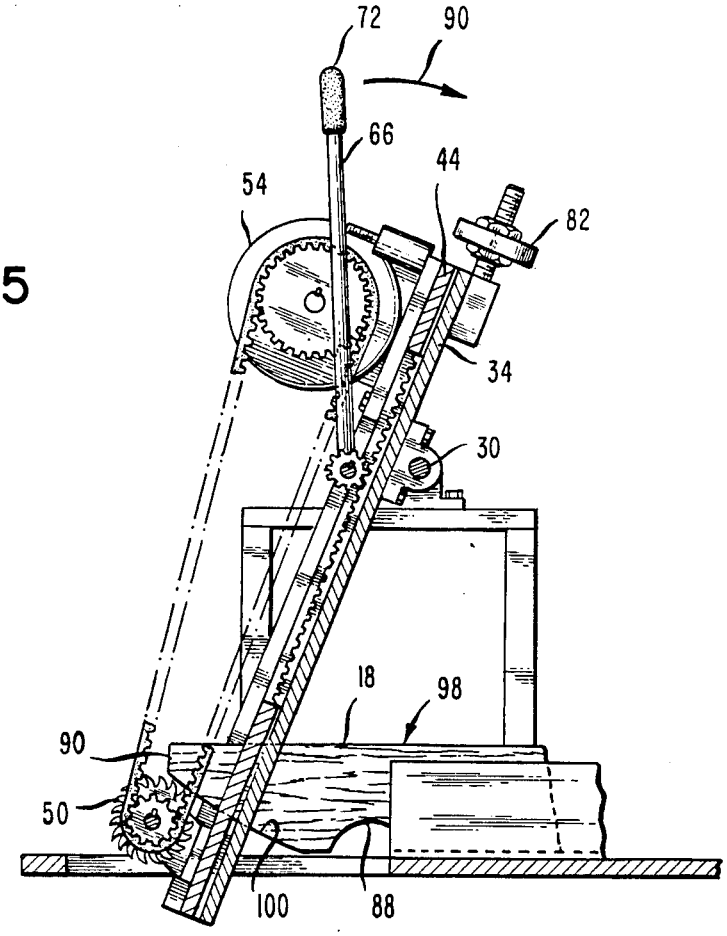
FIG. 5 is a side elevation, cross-sectional view of the apparatus shown in FIG. 3, in which an operating lever is manually operated in a clock wise direction.

FIG. 5 illustrates the position assumed by plate 34 and carriage 44, when manual lever 66 has free end 72 disposed in the direction of arrow 90, counter to direction 84—shown in FIG. 4. In this location, cutter 50, plate 34, carriage 44, motor 54 and all associated devices pivot about the axis of rod 30, such that the surface of cutter 50 describes an arc whose radius is equal to the distance separating the longitudinal axis of rod 30 and the longitudinal axis of cutter 50. Such arc is cut into the surface of workpiece 18 adjacent free end 90, and may be positioned contiguous work or spaced apart from notch 88, as desired. When workpiece 18 is rotated so as to have surface 98 thereof positioned downwardly, surface 98 may have another semi-circular notch, equivalent to notch 88 and disposed and cut into surface 98. Similarly, another semi-circular curved cutaway portion can be fabricated into workpiece 18, similar to the curved cut-away portion described by edge 100. Unlimited translation of cutter 50, in a direction shown by curved arrow 90 is prohibited by engagement of the lowermost regions of the tray and carriage with rod 40, shown in FIG. 1. Thus, the degree and extent of curve 100, shown in FIG. 5, may be limited—dependant upon the position of rod 40.

It can readily be seen that the extent of the semi-circular notch, placed in one of the workpieces, is controlled as to depth by a simple adjustment of a stop between the carriage and the tray. Similarly, the distance and degree of the curve established at the end of the workpiece, is similarly controlled by the adjustment of a stop. Most importantly, the simple manual manipulation of the operating lever, first in one direction until one of the stops is detected, and thence in the other direction, produces the pleasing and desirable effect of notching and curving the end of the workpiece. Obviously, if it is desired, only notching can take place, or—alternatively—only the curving or cutting away of the end of the workpiece alone may be obtained.

The primary advantage of the present invention is to provide a fence machining device which permits the workpiece to be machined easily and conveniently when such machine includes an indented semi-circular notch disposed into and along the length of the work piece.

Another advantage of the present invention is to provide a fence machining device which permits a fence workpiece to have one surface of the end thereof machined to describe a radial cut in the end, commencing on the side of the workpiece and terminating at the end thereof.

Still another advantage of the present invention is to provide a fence machining device which permits a simple fastening of the workpiece to the device, followed by minimal mechanical manipulations, so as to permit the workpiece to remain stationary whilst it is being machined.

Yet another advantage of the present invention is to permit a plurality of workpieces to be clamped together, machined together, such that each of the plurality of workpieces are machined identically.

Yet still another advantage of the present invention is to provide a device for machining fence parts which accurately and repeatedly machines diverse and opposing faces of a workpiece such that the workpiece, when viewed from any angle, is symetrical and uniform in appearance.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A fence post machining device comprising a workpiece supporting table, a plate, said plate hingably secured to said table, a carriage, means to slidably engage said carriage to said plate, said means to slidably engage including a rack, said rack being secured to said plate, a pinion, said pinion being mounted for rotation on said carriage, an operating lever, one end of said operating lever being coupled to said pinion, whereby manually manipulating said operating lever causes the rotation of said pinion and alternately and selectively displaces the longitudinal axis of said pinion along the length of said rack, a cutter, said cutter mounted for rotation on said carriage, means to selectively alternately slidably displace said carriage relative to said plate and to pivot said carriage about a line extending parallel to the plane defined by said work supporting surface, means to limit the amount of pivoting of said plate relative to said work surface, means to limit the amount of slidable translation of said plate to said carriage, means to removably secure a workpiece to said workpiece supporting surface.

2. The apparatus as claimed in claim 1, further comprising a motor, said motor being secured to said carriage, said motor coupled to said cutter for concurrent rotation about their respective longitudinal axis.

3. The apparatus as claimed in claim 1 wherein said means to limit said linear translation comprises a threaded rod, a disc, means to postion said disc along said threaded rod, one end of said threaded rod being secured to said plate, a poriton of said disc being engagable with an edge of said carriage.

4. The apparatus as claimed in claim 1 further comprising means to engage an end of said wooden workpiece a selected distance from said cutter.

5. The apparatus as claimed in claim 1 further comprising means to removably clampingly engage said workpiece to said surface of said worktable.

6. The apparatus as claimed in claim 1 further comprising fence-like support means, said fence-like support means being secured to said work supporting surface, one surface of said fence-like support means exending upwardly from said work supporting surface at right angles thereto.

* * * * *